United States Patent [19]

Bleser et al.

[11] Patent Number: 4,815,153

[45] Date of Patent: Mar. 28, 1989

[54] INFLATABLE PLAY PEN

[76] Inventors: Sandra L. Bleser; Robert D. Bleser, both of 221 Planter Dr., Tavernier, Fla. 33070

[21] Appl. No.: 145,439

[22] Filed: Jan. 19, 1988

[51] Int. Cl.[4] ..... A47D 9/00

[52] U.S. Cl. ..... 5/98 R; 5/99 A; 5/449

[58] Field of Search ..... 5/93 R, 98 R, 99 R, 5/99 C, 449, 450, 452; 446/220, 226

[56] References Cited

U.S. PATENT DOCUMENTS

| | | | |
|---|---|---|---|
| 2,561,016 | 7/1951 | Ford et al. | 446/220 |
| 2,784,420 | 3/1957 | Moltane | 5/98 R |
| 3,430,271 | 3/1969 | Junod-Deile | 5/93 R |
| 3,763,506 | 10/1973 | Szego | 5/99 R X |
| 3,833,947 | 9/1974 | Sorensen | 5/449 |

FOREIGN PATENT DOCUMENTS

| | | | |
|---|---|---|---|
| 2347526 | 4/1975 | Fed. Rep. of Germany | 5/99 C |

*Primary Examiner*—Gary L. Smith
*Assistant Examiner*—Michael F. Trettel
*Attorney, Agent, or Firm*—John C. Malloy

[57] ABSTRACT

In one embodiment, an inflatable play pen composed of an interconnected mattress portion, upper ring portion, and spaced apart support column portions supporting the ring portion above the mattress portion and with open netting or mesh material between the portions so that a child on the mattress portion is safely contained in a ventilated area on the mattress which has a lower central portion bounded by a peripheral portion somewhat higher than the lower central portion.

6 Claims, 1 Drawing Sheet

INFLATABLE PLAY PEN

BACKGROUND OF THE INVENTION

1. Field of the Invention

This invention relates to an inflatable containment structure, such as a play pen.

2. Description of the Prior Art

In the past, there have been numerous types of inflatable objects, such as balloons, simulated furniture, and flotation devices. This invention is of an infant containment structure such as a play pen or bed. It is composed of inflatable portions which are interconnected and which include a mattress portion, an upper ring portion above the mattress portion, and a plurality of spaced vertical column portions, which may be reinforced, and wherein the column portions are spanned by open work, such as netting material, to provide a contained ventilated zone or area for a child.

SUMMARY OF THE INVENTION

The present invention relates to a play pen having an inflatable structure and accordingly being readily positioned between its operative, inflated position and its stored position to facilitate traveling thereof when the structure is deflated. Throughout the subject structure is referred to as a play pen. However, it is to be emphasized that the structure of the present invention could in fact serve as a crib or sleeping facility for a child since the structure lends itself to being transported from one location to another and may easily be disposed into its operative position merely by an inflation.

Accordingly, the play pen structure comprises a mattress portion serving as the base of the structure and a peripherally surrounding containment means or wall primarily composed of a plurality of vertically oriented spaced apart support columns. A surrounding ring is secured to the upper portions of the support columns in spaced but connected relation to the mattress and extending there above.

The containment means including the support columns is further structured to allow ventilation to pass therethrough and preferably allow any child contained therein and supported on the mattress portion of the structure to visually observe his surroundings through the containment means. This is accomplished by the providing of a plurality of open netting or mesh material grid means secured between the spaced apart support columns on opposite peripheral sides thereof and also secured both to correspondingly positioned portions of the mattress and the ring portion. Each of the grid means, due to the aforementioned open mesh or netting-like material, has apertures defined therein of sufficient size to provide the intended ventilation and cooling effect to the infant or occupant within the containment wall while preferably at the same time being sufficient to allow visual observation of the surroundings. However, such apertures are not sufficient in size to allow an infant to become tangled or caught in this netting or open mesh material and is therefore safe for children of all practical ages who would use such equipment.

As will be described in greater detail hereinafter, the various portions or components of the subject play pen structure may have hollow interior portions, for the most part, each of which may communicate with one another so that only a single valve need be installed on the structure. In such an embodiment, filling of fluid through the single valve will effectively inflate all the intended components of the play pen structure since all of the hollow interior passages are disposed in fluid communication with one another. Alternatively, the various components including the mattress, support columns, upper surrounding ring, etc. may be separated, at least to the extent that separate valves are provided to inflate each of the various components. In either embodiment, inflation can readily occur through any number of commercially available inflation devices; or the device may be inflated orally just by applying air manually to the valve. While air may be the fluid utilized, other fluids may be used to inflate the structure.

OBJECT OF THE INVENTION

It is an object of this invention to provide an improved structure comprising an inflatable play pen which may be maintained in a clean condition, and, when not inflated for use, may be collapsed and readily stored or taken with a person when traveling.

It is a general object of this invention to provide an improved inflatable play pen made of fluid impervious materials which is composed of various portions which are interconnected so that through a valve means, fluid may be introduced into the portions to inflate it into a pen defining relation.

BRIEF DESCRIPTION OF THE DRAWINGS

Reference is made to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
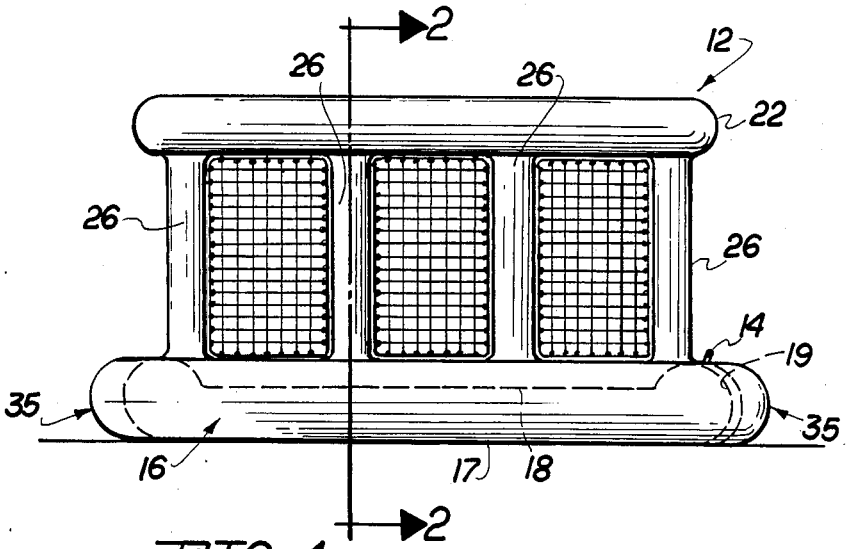
FIG. 1 is a front view of the play pen structure of the present invention with certain internal structures represented in phantom lines.

Referring to FIG. 1, there is shown and generally designated by the numeral 12 a collapsible and inflatable play pen. It is composed of portions made of fluid-impervious material, defining the inflatable body. As shown, it includes interconnected portions, with a valve means 14 for introducing fluid into it to inflate it. The structure comprises a mattress portion, a ring portion 22 disposed above the mattress portion, and a plurality of spaced apart support column portions, each indicated as 26 which we secured to the mattress and the ring and are disposed to support the ring above the mattress.

More particularly, the mattress portion 16 is seen to have a top 18, bottom 17 and side surfaces 19. It is adapted to rest on a support surface, such as a lawn, when outside, or a floor, when inside. In the illustrated embodiment, the top surface has a central lower zone 18 which is bounded by a peripheral zone 20. Of course, the central zone is not required to be lower. The top surface of the peripheral zone 20 is above the central zone of the mattress which is preferably, but not necessarily, of at least about six square feet in area. The ring portion 22 has a top surface and is sized to be vertically disposed above the peripheral zone 20 of the mattress portion 16 and includes a somewhat lesser transverse dimension than the size of the mattress.

Figure 2:
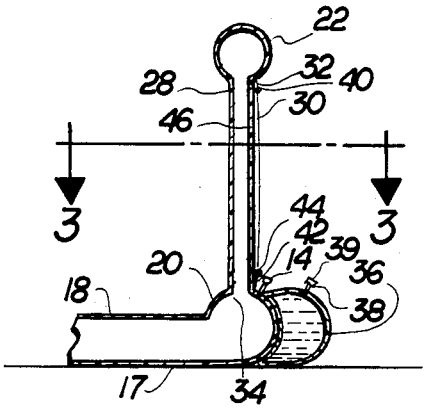
FIG. 2 is a sectional view along line 2—2 of FIG. 1.
Figure 3:
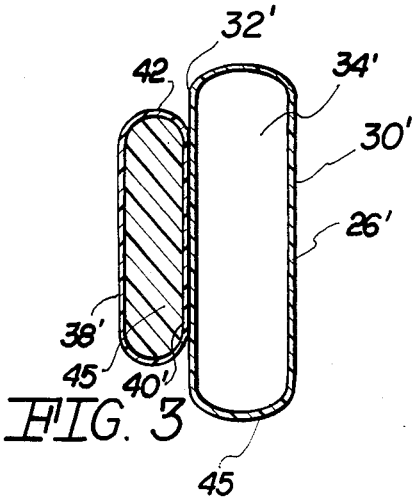
FIG. 3 is a sectional view along line 3—3 of FIG. 2.

A plurality of peripherally disposed and spaced apart vertical support columns, such as 26 interconnects the mattress and the ring. In a preferred embodiment, the support columns 26 should be generally cylindrical and be about the same cross-section as the top ring portion to provide sufficient support. Also, if desired, the support columns may be tapered somewhat or be of other suitable configuration. Spaces are provided between the ring portion, the support columns and the mattress portion. Each of the spaces is covered with a pliable open mesh or net-like material grid means which completely spans the respective spaces. In a preferred construction as shown in FIGS. 2 and 3, flap means 40 and 42 extend in confronting relation from the ring and mattress portions respectively into engagement with the grid means. More specifically, the flap means are provided with rings or openings 44 thereon as shown in FIG. 2. The open netting or mesh material from which the grid means are formed may include a strong nylon or like material which may be laced through the openings or loops in the flaps 40 and 42 to accomplish connection therebetween.

Similar connection of opposite sides of the grid means may be secured to the individual support column 26. This means of connection is representative only and in fact the grid may be integrally molded to the support columns and/or the mattress portion and ring portion 16 and 22 respectively or a continuation of the support columns.

In a preferred embodiment of the present invention, each of the components including the mattress portion 16, the ring portion 22 and the plurality of support columns 26 may have there hollow interior portion disposed in direct communication with one another. Accordingly, the interior of the support columns 26 may serve as air passages such that only a single air valve 14, used for inflation, need be provided. Air passing in through valve 14 into the interior of the mattress 16 flows through the "passage means" of the support columns filling the support columns and then passing continuously up into the ring 22 for inflation thereof.

Alternately, separate valve means may be utilized for each of the components wherein such an embodiment, the hollow interior of the various components as set forth above are not necessarily structured in fluid communication with one another. Accordingly, a plurality of such valves 14 must be constructed and utilized with each of the various mattress components, support columns 26 and ring portion 22.

Preferably, the overall height of the body is between 12 and 36 inches, or if desired, can be less or greater and accordingly the structure may even be used for older children. However, when older more active children use the structure, a stabilizer means 35 may be provided about the mattress. In one embodiment, the stabilizer means includes a hollow member 36 in engagement with opposite sides 19 of the mattress portion 16. Each hollow member may include inlet means and a closure means as indicated as 38 and 39 through which water may be introduced. The stabilizer means 35 may be removable and made of expandable tubular material and fastened to the play pen for ease of filling and emptying of the same. In other words, the stabilizer means can be filled separately and attached. The weight of the water on opposite sides of the mattress portion 16 will reduce the possibility of tipping the structure.

The inflatable play pen body may be of any suitable fluid impervious material, such as fluid impervious vinyl, or other molded plastic mesh or nylon netting.

While the preferred embodiment is generally round, other configurations are also possible and practical. Such other configurations may include the structure being elliptical, square or rectangular. If round, the preferred outside diameter is between 3 ft. and 6 ft. and if rectangular, the shorter length is at least 2 ft. and the longer length is about 6 ft.; and of a height between 12 and 36 inches. However, all measurements can be substantially longer or smaller. The open work spanning through portions and defining the sides, a portion of the side containment wall of the play pen may be netting or a nylon mesh molded into the support column portions. In either event, the openings of the grid means are sufficient to provide ventilation and visual observation, while reducing the possibility of the child becoming tangled in the open grid material.

Another embodiment of the present invention shown in FIG. 3 includes the columns as at 26' and as shown in partial sectional view has an outer wall 30' and an inner wall 32' and which are filled with fluid 34'. The embodiment may carry an exterior or interior pocket defining structure including a wall 38' and 40' with a pocket space 42' therebetween in which a rigidifying member 45, such as a panel, may be inserted to provide additional reinforcement for the columns.

The body may be inflated either orally, or using a hand pump, a foot pump or any applicable structure. Additionally, there may be an automatic inflation device provided, such as a pressure fluid canister with means to connect it to the air intake valve. The play pen structure may be in various and assorted colors and patterns, or clear material, if desired. Finally, stabilizers may be provided to insure a desired upright orientation and will be of similar materials, such as vinyl or rubber.

It is thus seen, that there has been provided an inflatable play pen which can be collapsed for storage or packed for travel and can be constructed in different sizes and shapes for either infants or toddlers and which is easy to clean and maintain in a clean condition which is safe, soft, and contains a child while sleeping or playing.

What is claimed is:

1. A collapsible and inflatable containment structure suitable for a young child and made of fluid impervious material, said structure comprising:

(a) an inflatable body including a mattress portion and a plurality of spaced apart support column portions secured to and extending upwardly from said mattress portion, (b) valve means disposed and structured to permit inflation and deflation of the body, said mattress portion having a top, bottom and side surfaces and being adapted to rest on a support surface, (c) said body further comprising an inflatable ring portion secured to an outer end of each of said support column portions in spaced relation to said mattress portion, (d) pliable open work grid means mounted between adjacent ones of each of said support columns and each grid means connected to both said mattress portion and said ring portion and each having a transverse dimension substantially greater than any of said support columns, (e) flap means for securing the grid means in the space between said support columns, said flap means formed on said ring portion, said mattress portion and on opposite longitudinal sides of said support column portions and extending outwardly therefrom into adjacent relation with corresponding edges of said open work grid means, (f) said flap means including openings formed therealong, connecting structure disposed in interconnecting relation between said openings of said flap means and said correspondingly disposed edges of said open work grip means for interconnection therebetween, and (g) said ring portion and said mattress portion being connected by fluid passages formed within said support columns and said ring portion extending continuously along and defining a periphery of an open top of said body.

2. An assembly as in claim 1 further comprising stabilizer means for preventing tipping of said body and including a fluid filled cavity secured to and extending continuously about said side surface on an exterior of said mattress portion and disposed in resting engagement on the common support surface on which said mattress is positioned.

3. An assembly as in claim 2 wherein said fluid filled cavity is filled with liquid.

4. The device as set forth in claim 1 wherein said valve means comprises a single valve effective to inflate the body portions of the different through said fluid passages.

5. The device as set forth in claim 1 wherein the height of the body, when inflated, is between 12 inches and 42 inches.

6. The device as set forth in claim 1 wherein the central zone of the top surface of the mattress portion is at least 6 square feet in area.

* * * * *